United States Patent [19]

Kosoris

[11] Patent Number: 4,846,751

[45] Date of Patent: Jul. 11, 1989

[54] FLOATING TOY

[76] Inventor: Barry W. Kosoris, 2210 Sandy Dr., Eugene, Oreg. 97401

[21] Appl. No.: 200,589

[22] Filed: May 31, 1988

[51] Int. Cl.[4] ..... H63H 23/02

[52] U.S. Cl. ..... 446/160; 446/161

[58] Field of Search ..... 446/160, 161, 162, 163

[56] References Cited

U.S. PATENT DOCUMENTS

| | | | |
|---|---|---|---|
| 1,205,759 | 11/1916 | Lewis | 446/161 |
| 1,361,561 | 12/1920 | Yancey | 446/161 |
| 1,595,828 | 8/1926 | Fuller | 446/163 |
| 1,893,507 | 1/1933 | Ranney | 446/163 |
| 2,089,888 | 8/1937 | Garrett | 446/161 |
| 2,405,715 | 8/1946 | Sabini | 446/161 |
| 2,511,323 | 6/1950 | Briggs et al. | 446/163 |
| 2,538,347 | 1/1951 | Yates et al. | 446/163 |
| 2,931,134 | 4/1960 | Nevitt | 446/160 |
| 3,281,984 | 11/1966 | Wechsler | 446/163 |
| 3,561,155 | 2/1971 | Tarrson | 446/160 |
| 4,292,758 | 10/1981 | Kuna et al. | 446/163 |

*Primary Examiner*—Richard J. Johnson
*Assistant Examiner*—Lynda M. Cofsky
*Attorney, Agent, or Firm*—James D. Givnan, Jr.

[57] ABSTRACT

A toy for the bathtub and having a somewhat conical chamber in which a quantity of suds and bubbles may be confined. The chamber merges upwardly with a restricted passageway which in turn terminates upwardly in a nozzle. Displacement downwardly of the toy in the water causes forceful ejection of the suds and bubbles from the nozzle.

6 Claims, 1 Drawing Sheet

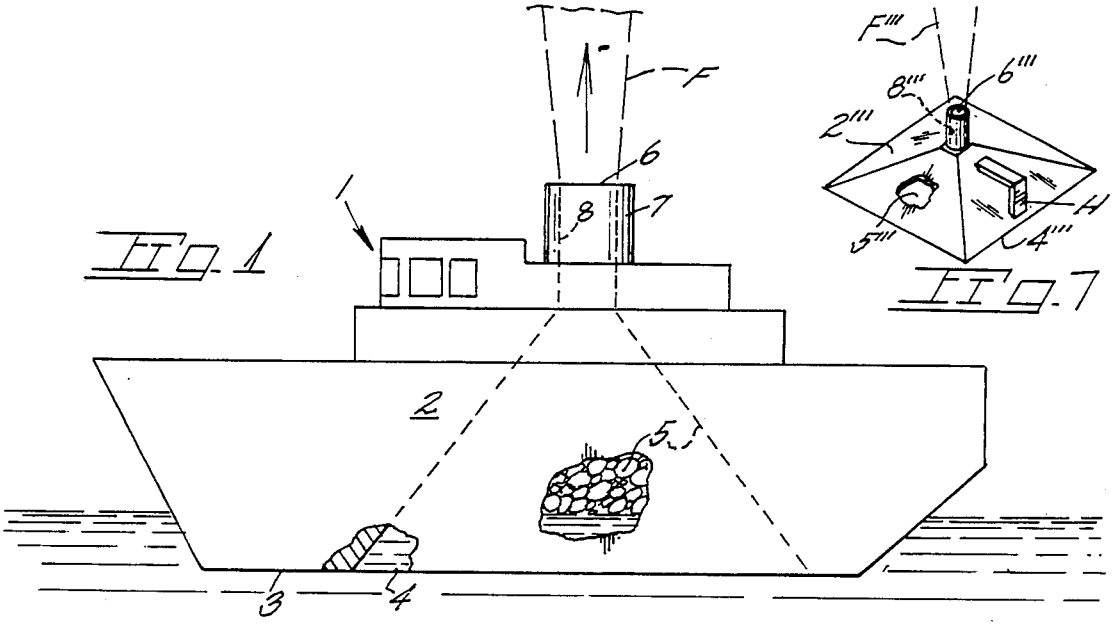
FIG. 1
FIG. 7
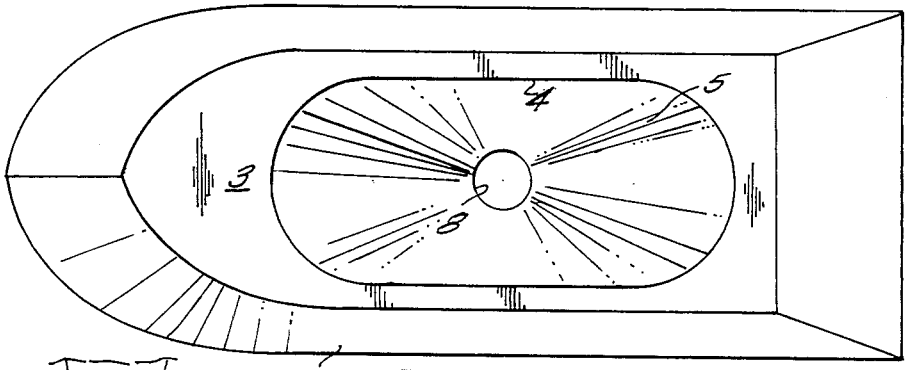
FIG. 2
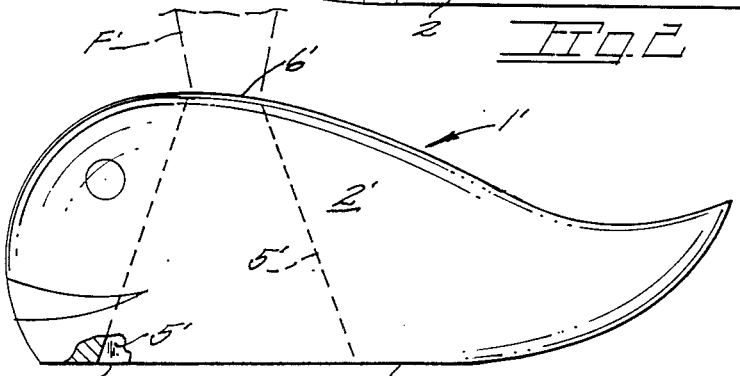
FIG. 3
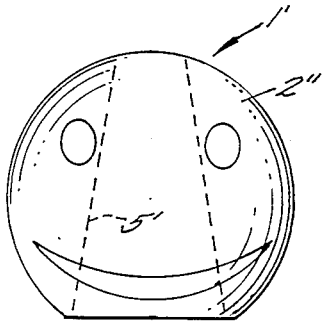
FIG. 4
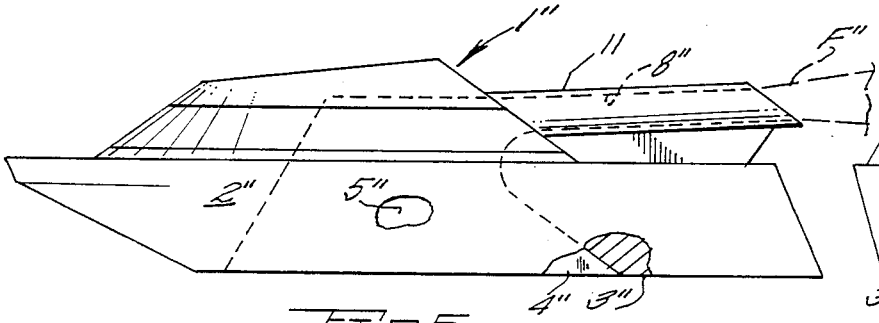
FIG. 5
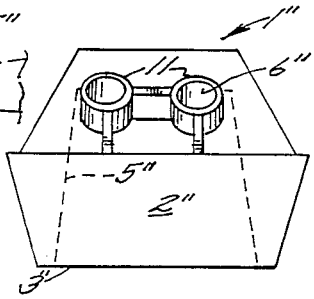
FIG. 6

FLOATING TOY

BACKGROUND AND SUMMARY OF THE PRESENT INVENTION

The present invention concerns toys of the general type commonly used to amuse young children in the bath.

Children are often entertained during their bath by the presence of bubbles and suds which serve to keep the child occupied.

The present invention is embodied in a toy for use in the bath which permits the child to operate the toy in a manner causing soap suds and water to be discharged from the toy in a somewhat forceful and intriguing manner.

The toy is of buoyant construction and defines a chamber in which water and suds are confined for discharge upon rapid downward displacement of the toy in the water. A sizable inlet area formed in the toy serves to collect a quantity of suds and water which are subsequently discharged via a nozzle in the toy to produce a simulation of engine exhaust gases, whale spouts, etc. The exhaust nozzle may be embodied at the end of an exhaust structure such as a toy boat smokestack, exhaust pipe or other shape compatible with the configuration of the toy.

BRIEF DESCRIPTION OF THE DRAWINGS

In the accompanying drawings:

FIG. 1 is a side elevational view of a toy boat embodying the present invention;

FIG. 2 is a bottom plan view thereof;

FIG. 3 is a side elevational view of a toy whale embodying the present invention;

FIG. 4 is a left-hand elevational view of FIG. 3;

FIG. 5 is a side elevational view of still another toy boat embodying the present invention;

FIG. 6 is a right-hand elevational view of FIG. 5, and

FIG. 7 is a perspective view of still another form of the present toy.

DETAILED DESCRIPTION OF THE PREFERRED EMBODIMENTS

With continuing attention to the drawings wherein applied reference numerals indicate parts similarly hereinafter identified, the reference numeral 1 indicates generally a toy boat embodying the present invention.

A boat hull constitutes a three-dimensional buoyant body 2 having a lower or bottom surface 3 which defines an opening or inlet area 4.

Body 2 includes internal wall structure which defines a somewhat conical chamber 5 in communication with said inlet area and into which water, bubbles and soap suds may enter when the toy boat is used in a bathtub.

A nozzle at 6 is shown embodied in a smokestack 7 of the toy boat which defines a passageway 8 extending between chamber 5 and nozzle 6.

Another embodiment of the invention is shown in FIGS. 3 and 4 as a toy whale wherein parts to those above described are identified by prime reference numerals. It will be noted that the passageway is dispensed with in the toy whale form of the invention. Further, the internal walls are shown as forming a chamber of frustoconical shape.

In FIG. 5, a second toy boat is shown wherein parts similar to those above described are identified by double prime reference numerals. An engine exhaust outlet a pipe is simulated by substantially horizontal tubular structures 11 which terminate in nozzles 6''. Passageways at 8'' extend from a chamber 5''. Internal wall structure is shown as being defined by planar walls which, of course, may be otherwise shaped.

In use, the toy is placed on the water surface in a manner entrapping a quantity of suds and bubbles whereafter downward displacement of the toy by the child will cause the suds and water in the chamber of the toy to be displaced out the nozzle in a rapid manner to simulate engine exhaust or the spouting of a whale. It will be understood that the buoyant body 1 may take various shapes that will be attractive to young children. Discharge flows from the toys are indicated at F.

In FIG. 7, a bathtub toy is shown in perspective to disclose a toy having a buoyant body 2''' of pyramidal shape with walls defining a chamber 5''' which terminate downwardly in a perimeter defining an inlet opening 4'''. A handle H is carried by body 2'''. Said body terminates upwardly in a passageway 8'''. A nozzle 6''' is in downward communication with the passageway and with chamber 5'''. While the preferred form includes passageway 8''', the same may be dispensed with in which instance nozzle 6''' is embodied at the apex of the pyramid. A forceful flow of bubbles out the nozzle is effected by rapid manual movement of the toy through a quantity of bubbles on the surface of the bath water.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

I claim:

1. A toy for use in the bathtub and comprising, a three-dimensional buoyant body having a submergible bottom surface defining an inlet opening, internal upwardly converging wall means in the body defining a generally conical chamber in downward communication with said inlet opening, and a nozzle in said buoyant body above the waterline area in open communication with said chamber and out of which may be discharged bubbles and water upon water advancing into said chamber as the toy is forcefully submerged.

2. The toy claimed in claim 1 wherein said body additionally defines a passageway between said chamber and said nozzle.

3. The toy claimed in claim 1 additionally including a horizontal tubular structure communicating said chamber with said nozzle.

4. The toy claimed in claim 1 wherein said wall means includes a continuous inclined wall.

5. The toy claimed in claim 1 wherein said chamber is of generally frustoconical shape.

6. A toy for use in a bathtub and comprising, a three-dimensional buoyant body having a submergible bottom surface defining an inlet opening, internal upwardly converging planar walls in the body terminating downwardly at said bottom surface inlet opening and defining a chamber in downward communication with said opening, and a nozzle in said buoyant body above the waterline area in open communication with said chamber and out of which may be discharged bubbles and water upon water advancing into said chamber as the toy is forcefully submerged.

* * * * *